United States Patent [19]

Klimaszewski

[11] 4,062,132

[45] Dec. 13, 1977

[54] FOOTWEAR HAVING REPLACEABLE HEEL AND SOLE

[76] Inventor: Chester Klimaszewski, 84 Farview Drive, Cheshire, Conn. 06410

[21] Appl. No.: 721,596

[22] Filed: Sept. 8, 1976

[51] Int. Cl.[2] ..... A43B 3/24
[52] U.S. Cl. ..... 36/100
[58] Field of Search ..... 36/100, 101

[56] References Cited

U.S. PATENT DOCUMENTS

| | | | |
|---|---|---|---|
| 2,707,341 | 5/1955 | Romano | 36/100 |
| 3,000,116 | 9/1961 | Ally | 36/101 |
| 3,012,341 | 12/1961 | Schaefer | 36/100 |

FOREIGN PATENT DOCUMENTS

| | | | |
|---|---|---|---|
| 2,217,397 | 11/1972 | Germany | 36/101 |

*Primary Examiner*—Patrick D. Lawson
*Attorney, Agent, or Firm*—Robert D. Farkas

[57] ABSTRACT

Footwear having a body portion receptive of a person's foot during use and a replaceable tread portion. The tread portion is releasably locked into the body portion by a flange having gripping members on the inner peripheral surface. The tread portion has a hollowed top portion having an outer peripheral surface with gripping apertures therein in which the gripping members are received. The outer peripheral surface of the hollowed top portion is closely received in the flange and the tread portion is thus prevented from moving both laterally and perpendicularly thereby.

3 Claims, 4 Drawing Figures

FOOTWEAR HAVING REPLACEABLE HEEL AND SOLE

BACKGROUND OF THE INVENTION

The present invention relates to footwear having a replaceable heel and sole.

Footwear of this type are known in the prior art, but these footwear have the disadvantage of having complex construction for preventing the lateral and perpendicular movement of the tread with respect to the body. Examples of prior art toorwear that show replaceable tread portions, but do not show the tread being engaged at the outer peripheral surface thereof to prevent both lateral and perpendicular movement of the tread with respect to the body of the footwear, are U.S. Pat. Nos. 1,654,445; 1,758,342; 1,773,242; 2,528,951; 3,019,534; 3,073,042; 3,538,628 and 3,693,369.

SUMMARY OF THE INVENTION

The principle object of this invention is to provide footwear having a replaceable tread portion.

This and other objects are achieved by the preferred embodiment of the present invention in which a body portion of a shoe receptive of a person's foot has a rigid flanged member disposed around and affixed to the lower portion of the body portion. The inner surface of the flange has a plurality of gripping members disposed thereon. A resilient tread portion having a plurality of apertures each corresponding to a gripping member is configured to be received within the flange member. The tread member is locked both laterally and perpendicularly with respect to the flange member but may be removed by deforming side portions of the tread member to separate it from the gripping members.

Having in mind the above and other objects that will be obvious to and enable those persons skilled in the art to clearly understand the function, operation, construction and advantages of it when read in conjunction with the accompanying drawing.

BRIEF DESCRIPTION OF THE DRAWING

The invention will be described in detail by way of example, with reference to the accompanying drawing, in which.

DETAILED DESCRIPTION OF THE INVENTION

Figure 1:
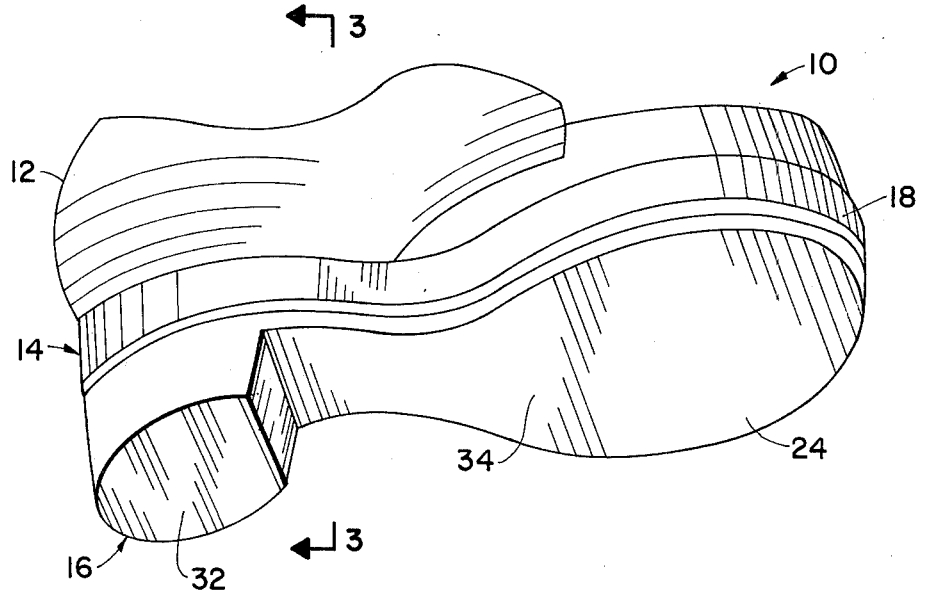
FIG. 1 is a perspective view of the preferred embodiment utilizing the principles of the present invention.
Figure 2:
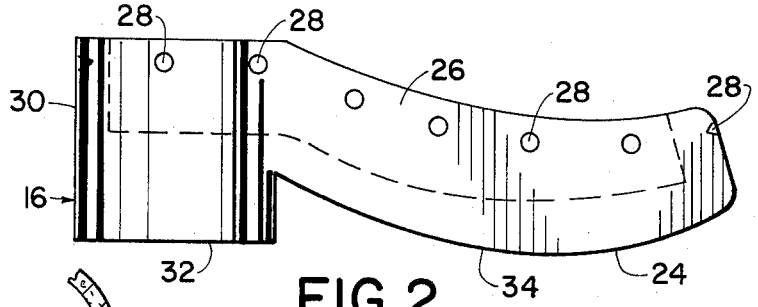
FIG. 2 is an elevational view of the tread portion.
Figure 3:
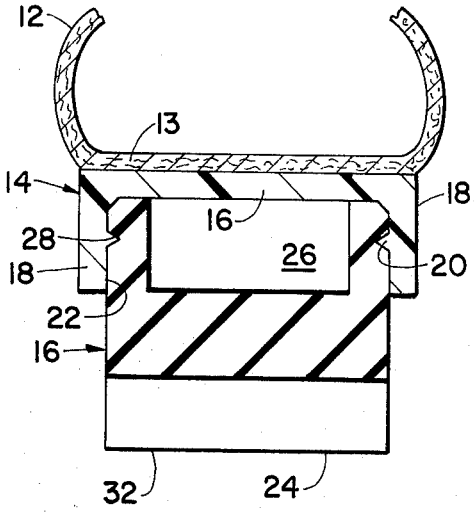
FIG. 3 is a side sectional view taken along line 3—3 in FIG. 1.

Referring to FIGS. 1–4 of the drawings, and in accordance with the principles of the invention, footwear 10 is shown comprising a body portion 12 having a lower surface 13 and receptive of a person's foot during use, a rigid flanged member 14 affixed to the lower surface 13 and a replaceable tread portion 16 capable of being received within the flange member.

The flanged member 14 is fixedly connected to the lower surface 13 of the body portion 12 at a base 16 thereof. A flange 18 extends outwardly from the periphery of the base 16.

A plurality of gripping members 20 configured as conical projecting tips is disposed on the inner peripheral surface 22 of the flange 18.

Figure 4:
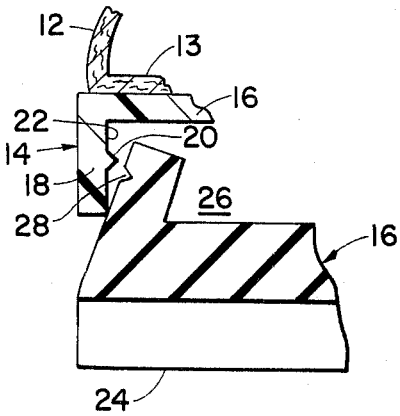
FIG. 4 is a partial sectional view.

The tread member 16 includes a lower treading surface 24, a hollowed resilient portion 26 opposite the treading surface 24 and a plurality of apertures 28 each aligned to and corresponding with one gripping member 20 and closely receptive thereof, said apertures disposed on the outer peripheral surface 30 of the hollowed portion 26. The lower treading surface 24 includes a heel 32 and a sole 34 aligned with the outer peripheral surface 30 and the integral with the tread member 16. The hollowed portion on 26 is configured to be closely received within the flange 18. Entrance and removal is accomplished by deflecting the hollow resilient portion 26 as shown in FIG. 4. Once installed, both lateral and perpendicular movement of the tread member 16 with respect to the body portion 12 is precluded.

While the preferred embodiment of the invention have been shown by way of example, in the drawing, it will be understood that the invention is in no way limited to these embodiments.

What is claimed is:

1. Footwear comprising a replaceable tread portion having a lower treading surface and including first means disposed opposite said treading surface and having an outer peripheral surface, a body portion receptive of a person's foot during use and having a lower surface and including second means fixedly connected to said lower surface and receptive of the outer peripheral surface of said first means and engagable therewith for releasably locking said first means therein to prevent both lateral and perpendicular movement of the tread portion with respect to said body portion, said tread portion including a heel and a sole, wherein the peripheral surface of said first means is aligned with the peripheral surface of the heel and sole, said first means includes a hollowed member composed of resilient material and projecting oppositely from said treading surface, means defining a plurality of gripping apertures in the outer peripheral surface of the hollowed member, said second means including a base member on said lower surface and a flange extending outwardly therefrom and configured to closely receive said hollow member and a plurality of gripping members disposed on the inner peripheral surface of said flange and disposed in alignment with said gripping apertures and receivable therein when the hollow member is received in the flange.

2. Footwear according to claim 1, wherein said second means is composed of rigid material.

3. Footwear according to claim 1, wherein said first means is integral with the remainder of the tread portion.

* * * * *